United States Patent [19]

Aker et al.

[11] 3,985,249

[45] Oct. 12, 1976

[54] QUICK CHANGE ATTACHMENT

[75] Inventors: Ludwig E. Aker, Hamilton; Frederick A. Skanes, Burlington, both of Canada

[73] Assignee: International Harvester Company, Chicago, Ill.

[22] Filed: Apr. 14, 1975

[21] Appl. No.: 567,914

[52] U.S. Cl. ..... 214/145 A; 172/275

[51] Int. Cl.[2] ..... E02F 3/81

[58] Field of Search..... 214/145 A, 131 A, 620; 172/272, 273, 275

[56] References Cited

UNITED STATES PATENTS

| | | | |
|---|---|---|---|
| 3,204,793 | 9/1965 | Lane | 214/145 A |
| 3,606,052 | 9/1971 | Schurz | 214/145 A |
| 3,760,883 | 9/1973 | Birk | 214/145 A |
| 3,887,096 | 6/1975 | Wieland | 172/272 |

*Primary Examiner*—Robert J. Spar
*Assistant Examiner*—Ross Weaver
*Attorney, Agent, or Firm*—Douglas W. Rudy; Floyd B. Harman

[57] ABSTRACT

An attachment for use on loader booms that enables quick changes of working implements. The attachment having an implement carrier frame provided with carrier saddles and slots positioned to carry and locate standard mounting pins in stock implement mounting frames such that the implement is automatically locked to the carrier frame via the means of automatic locking devices of spring loaded pins in receiving apertures.

9 Claims, 7 Drawing Figures

QUICK CHANGE ATTACHMENT

BACKGROUND OF THE INVENTION

1. Field of the Invention

The invention relates to loader attachments that are designed to accommodate a broad range of boom carried implements to be utilized alternatively with a single boom assembly.

2. Description of the Prior Art

It has been known to provide a permanent implement carrying frame on loader booms for quick attachment to an array of work implements. Various types of attaching systems have been developed. These generally consist of an alignment means mounted on the loader boom that is compatible to receive an appropriately modified implement such that alignment between the alignment means and the implement is attained. After the implement is positioned it is usually locked in place by the operator either with manually or hydraulically controlled pins, bars or latches.

Quick attach loader assemblies are also known wherein extensive modification to the implements to be used on the loader boom assemblies must be made in order that the combination can be used.

This invention alleviates numerous shortcomings in the state of the art of which the most obvious are; the extensive modifications of implements in order to make them compatible with the system and closely fitting alignment devices which present attaching difficulties in the field due to the necessity of perfect alignment of components prior to locking. Another disadvantage of some of the state of the art of quick assemblies is the active part that the operator plays in locking the implement in place which would contribute to a safety hazard if he would forget to lock the implement in position prior to operating.

The instant invention requires that no action be taken by the vehicle operator in order to lock an implement to the carrier frame. This is accomplished completely automatically minimizing exposure to safety hazards.

Stock implements normally compatible with the boom of the loader vehicle being used don't require extensive modifications as with some systems. They need only have one hole drilled in each outboard plate of the stock mounting channels to accommodate a locking pin. Simple and straightforward attaching means with few moving parts optimize the present service life of this quick change system.

SUMMARY OF THE INVENTION

The present invention is concerned with quick attach fixtures for fixing implements to a boom of loader vehicles.

More particularly, it is concerned with an implement carrier frame that can be pivotally mounted on a loader boom assembly having a loader boom and an implement operating link to carry implements having the usual mounting pins inserted in the usual mounting holes of the implement. The carrier frame is constructed having two horizontally spaced apart carriers mounted on either end of a transverse stabilizer, each carrier having an upwardly opening carrier saddle and bottom pin alignment slot positioned to accept the pins mounted in their usual position on the work implement. Locking mechanisms are mounted on a bracket on each the left and right carriers such that when the locking mechanisms are activated the implement is automatically locked to the carrier frame and hence the boom assembly through the interaction of a kickoff means mounted on each boom and the handle of the locking mechanisms.

Locking mechanisms can be disengaged by pulling a handle mounted on the outboard end of each locking pin. A locking pin can be detained in a disengaged position by rotating the handle and positioning it such that an extension of the handle is held in tension on a detent. The automatic locking mechanism can only be maintained in a disengaged position when either the carrier frame is rotated forward slightly (when an implement is hanging in the pin carrying saddles) or when no implement is hanging in the carrier frame.

The primary object of this invention is to provide a quick change attachment for allowing the use of a multitude of implements on a loader vehicle.

Other objects of the invention are to provide a quick change attachment that is easy to use under field conditions, self-aligning, automatically locking, and sturdy and positive in use.

A further object is to provide a system that can be retrofitted to current loaders and implements without the need for significant component modifications.

BRIEF DESCRIPTION OF THE DRAWINGS

Other objects of the invention will become apparent upon referring to the accompanying drawings which are illustrative of the invention.

FIG. 2 is a front elevation view of the quick attach carrier frame taken through plane 3—3 of FIG. 2;

DETAILED DESCRIPTION OF THE DRAWING

Figure 1:
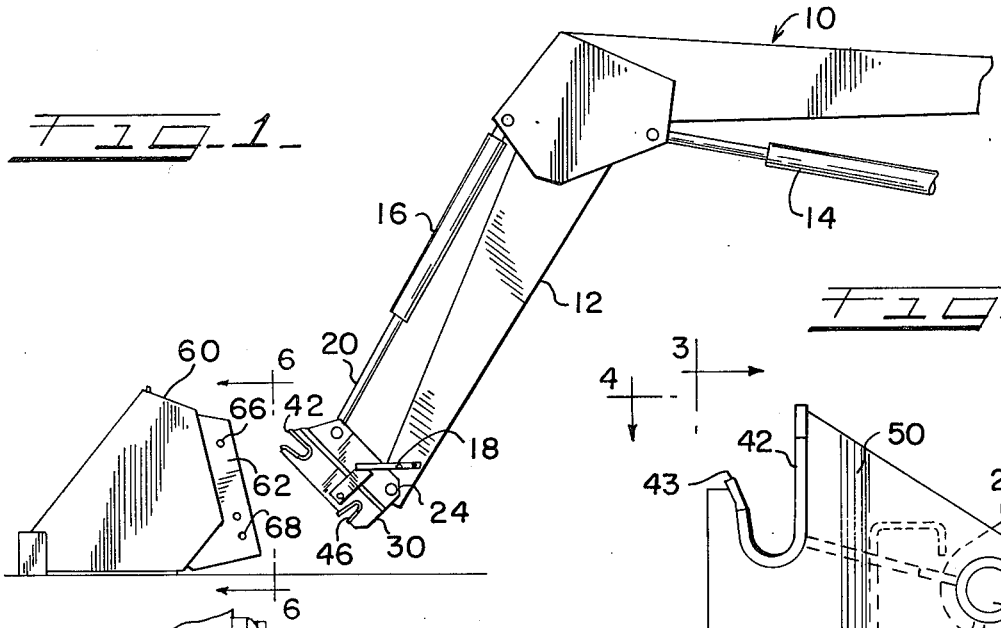
FIG. 1 is a side view of a loader bucket about to be mounted on a quick attach carrier frame and a partial loader boom.

The preferred embodiment of the invention as well as specific features and many of the attendant advantages of this invention will be readily appreciated as the invention is explained by reference to the following detailed description when considered in connection with the accompanying drawings in which like reference numerals designate like parts.

Looking first at FIG. 1 a fragmentary forward portion of a forward extending loader boom assembly generally depicted as 10 consisting of a boom 12, a fragmentized forward portion of a conventional boom lift cylinder 14 pivotally attached to the boom 12 at one end and to the vehicle frame (not shown) at the other end such that the boom assembly 10 can be adjustably raised or lowered. Loader tractors generally have a left and right boom assembly mounted outboard of the body of the vehicle. Only the left boom is shown in FIG. 1, that corresponding to the left side of an observer at the rear of the vehicle facing the vehicle.

Figure 2:
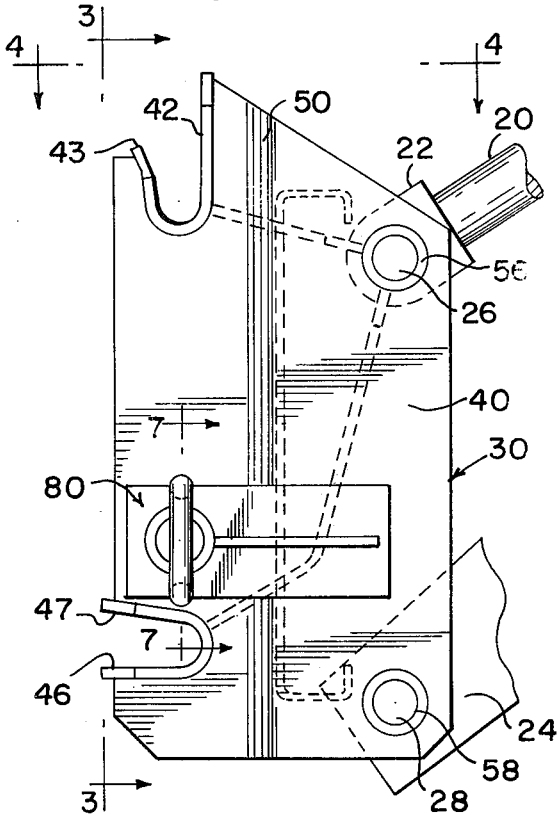
FIG. 2 is an elevation view of the quick attach carrier frame.
Figure 3:
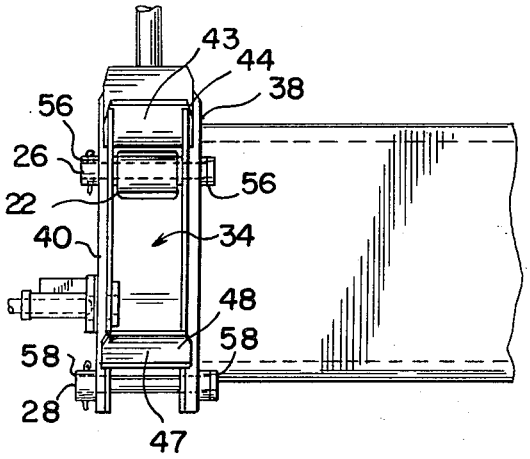
Figure 3:
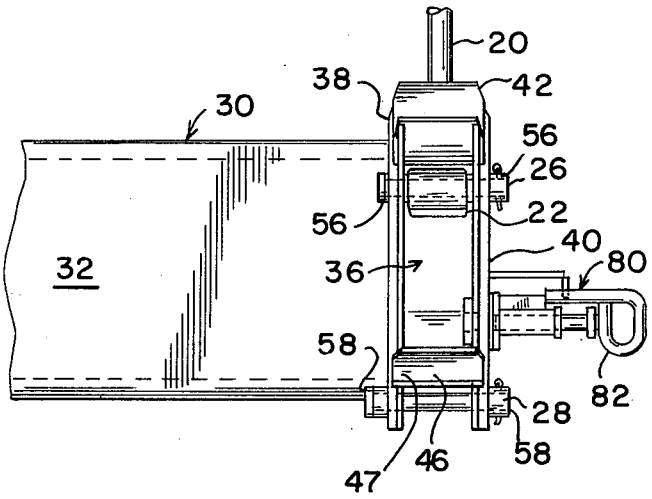
Figure 6:
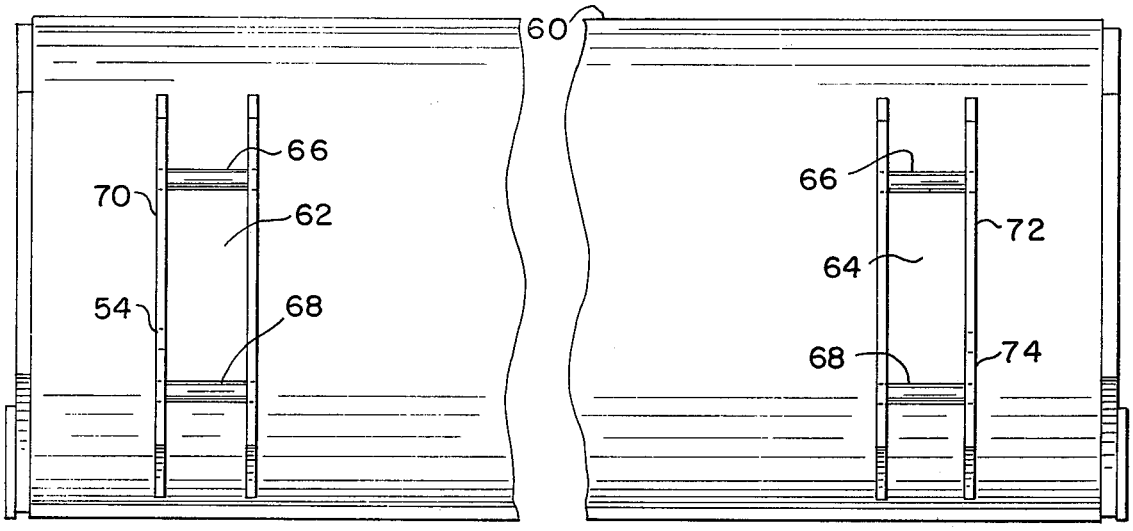
FIG. 6 is an elevation view of the rear surface of a loader bucket taken as plane 6—6 of FIG. 1.
Figure 5:
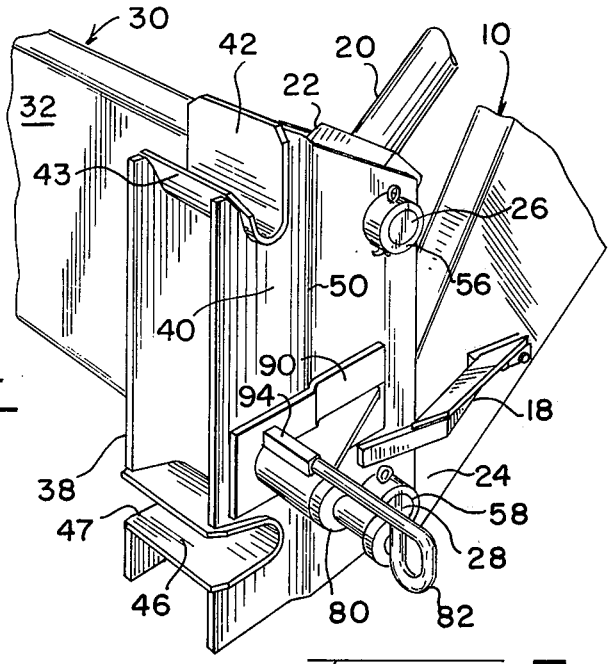
FIG. 5 is a perspective view of the left carrier of the quick attach frame with boom means and mounting pins.

Referring additionally to FIGS. 2, 3, and 5 it is shown that the implement carrier frame 30 is mounted on the boom assembly 10 using first top mounting pins 26 and first bottom mounting pins 28 which are positioned through first top apertures 56 of the outboard attaching plate 40 of the implement carrier frame 30 and in the first bottom apertures 58 of the same plate; then passed through the top pin receiving means 22 of an implement cylinder piston rod 20 of implement cylinder 16 and the bottom pin receiving means 24 at the forward end of the boom 10; and finally passing through the first top aperture 56 in the inboard attaching plate 38 of the implement carrier frame 30 and the first bottom aperture 58 of the same plate. Mounting pins 26 and 28 are retained in position using conventional means such as cotter pins. This pin mounting technique is used on both the left and right booms. However, it is felt that only one attaching sequence need be described for an understanding of the technique which is similar to the normal boom-implement attaching system well known in the art. In order to attach the implement carrier frame 30 which is now an integral component of the boom assembly 10 to the implement, in this case exemplified by a bucket 60 (FIGS. 1 and 6) which has second top mounting pins 66 and second bottom mounting pins 68 permanently located in each of the left and right mounting channels 62 and 64. It is only necessary for the loader vehicle operator to lower the bottom assembly 10 by means of the boom lift cylinder 14; roll the implement carrier frame 30 forward by means of the implement operating link, in this case cylinder 16; drive the loader forward while aligning the pin carrying saddles 42 and 44 with the mounting pins 66 in the bucket 60; position the carrier frame 30 such that the left 42 and right carrying saddle (right shown only in FIG. 3) engage the second top mounting pins 66 which are a permanent fixture in the left and right mounting channels 62 and 64 respectively (FIG. 6); roll the carrier frame backward with the implement cylinder 16 such that the second bottom mounting pins 68 of bucket 60 will swing toward the bottom pin slots one shown as 46. When the bucket carrier frame has been rolled back far enough and there is sufficient ground clearance, the bucket 60 will be in position. Specifically second top mounting pins 66 will be resting in the pin carrying saddles 42 and 44 and second bottom mounting pins 68 resting on the rear curved surface of the forward opening pin alignment slots 46 and 48 to be locked into place through the means of automatic locking mechanism 80. (Detailed in FIG. 7).

Figure 4:
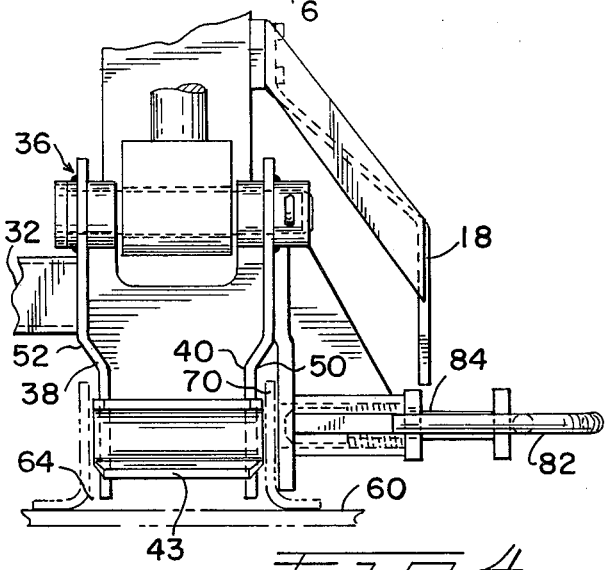
FIG. 4 is a plan view of a portion of the quick attach frame through lines 4—4 of FIG. 2 having mounting pins installed and a portion of an implement mounted in position.

It is necessary to point out (referring to FIGS. 4 and 7) that the inboard and outboard walls 38 and 40 of both left and right carriers 36 and 34 are spread apart further at the rear sections which houses the boom assembly 10 than they are at the forward sections, which are offset inwardly, which must be sufficiently narrow to fit into the a mounting channels 62 and 64 of the implement 60. This is accomplished by the vertical creases 50 and 52 in the outboard and inboard plates 40 and 38. Upper recesses connected by a plate 43 form the pin carrying saddles 42 and 44 and lower recesses connected by a plate 47 form the alignment slots 46 and 48. It is disclosed that both the left and right carriers, which are fixedly linked together with the transverse stabilizer 32, having this offset configuration.

Automatic locking of the implement had been accomplished coincidental to the bucket 60 swinging into position as described above. Automatic locking was facilitated by means of interaction of the kickoff means 18, a projecting rod attached to the boom contacting the retracting handles 82, best shown in FIG. 5, (when the implement carrier frame was rolled back past vertical) which were released from the restrained position allowing the locking pins 84 (both left and right) to pass through the locking pin apertures 74 and 54 in the outboard flanges 72 and 70, right and left respectively, of the implement mounting channels 62 and 64 of FIG. 6, and the outboard attaching plate of the left 36 and right 34 carriers of the implement carrier frame 30.

Figure 7:
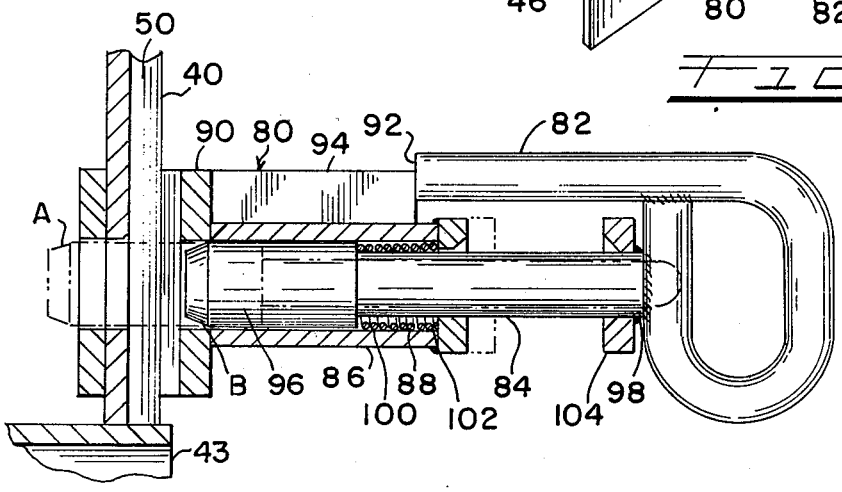
FIG. 7 is the locking pin assembly of the invention in partial section.

Referring to FIG. 7 it is shown that the retracting handles 82 previously noted, (which have been placed in a retained position by the operator when he detached the previous implement) are integral with the aft section 98 of the locking pins 84, which in themselves are carried in cylindrical containers 86 along with the biasing means 88 which tends to exert pressure on the locking pin 84 such that the locking pin will attempt to escape the container when not restrained by the retracing handle extension 82 in either a locked position A or a restrained position as shown by position B of FIG. 7.

The locking pin 84 (FIG. 7) has a leading portion 96 which is larger in diameter than the aft section 98 such that biasing means 88 is captive between surface 100 and a second surface 102 at the outboard end of pin container 86. The handle collar 104 prevents the biasing means 88 from urging the locking pin 84 completely out of the container 86 as the handle collar 104 will not pass through the outboard end of the pin container 86.

The automatic locking mechanism 80 is mounted on a mounting plate 90 (FIG. 5) that is fixedly attached to the rear (widest) portion of the outboard wall 40 and is offset away from the outboard wall at its forward portion so that the outbound implement flange 70 can fit between the attaching plate and the mounting plate 90.

The loader is now in readiness to be used as desired by the operator.

Detaching the bucket, or other implements, from the implement carrier frame 30 is safe and simple when performed as follows.

The operator positions the bucket 60 through manipulation of the boom lift cylinder 14 and the implement cylinder 16 slightly off the ground in a substantially level position in order to minimize binding between the locking pins and the locking pin apertures 74 and 54 of the outboard implement mounting flanges 72 and 70 and the outboard walls 40. The retraction handle 82 is then pulled outwardly (FIG. 7) causing locking pin 84 to be retrieved from the locking pin aperture 74. Once the locking pin is clear of bucket 60 the locking handle is rotated such that landing surface 92 of an extension on the locking handle rests on the flat end of the lockout stop means 94 causing the locking pin 84 to remain in the retracted position until it is again disengaged by means of the kickoff means 18 described earlier.

The implement is now free to swing forward in the pin carrying saddles 42 and 44 of the implement carrier frame 30. This will be so unless the operator rolls the carrier back causing relocking of the implement. In order to drop the implement the operator will roll the carrier frame 30 forward while lowering the boom 12. When the implement is detached, the pin carrying saddles 42 and 44 (FIG. 3) are free of the second top mounting pins 66 (FIG. 6), the operator backs the vehicle from the resting implement.

It should be understood that care should be exercised in keeping the implement carrier frame free of accumulated dirt, brush, rocks, etc. and also in good alignment. This is necessary to prevent a faulty mating of the implement to the implement carrier frame.

Thus, it is apparent that there has been provided, in accordance with the invention, a quick change attachment that fully satisfies the objects, aims, and advantages set forth above. Although the invention has been described in conjunction with a specific embodiment thereof, it is evident that many alternatives, modifications, and variations will be apparent to those skilled in the art in light of the foregoing description. For example, the invention might be equally utilized on other types of implements or vehicles. Accordingly, it is intended to embrace all such alternatives, modifications and variations as fall within the spirit and scope of the appended claims.

What is claimed is:

1. A quick change attachment for use on a loader boom assembly comprising:

an implement carrier frame having a left and a right carrier attached to a transverse stabilizer and spaced apart from each other at either end of said transverse stabilizer;

pin means for attaching said implement carrier frame to said boom assembly comprising first top and first bottom pair of mounting pins;

a work implement having upper and lower apertures;

second top and bottom mounting pins for insertion into said work implement apertures;

means for attaching said work implement to said implement carrier frame having a pair of carrier saddles incorporated in said left and right carriers that are capable of receiving the second top mounting pins;

means for aligning said work implement with said implement carrier frame comprising a pair of alignment slots that are capable of receiving said second bottom mounting pins;

an automatic locking mechanism carried on each of said carriers of said implement carrier frame to secure said work implement to said implement carrier frame;

a kickoff means mounted on said loader boom assembly of sufficient length that it will initiate locking action through interaction with said automatic locking mechanism when the implement carrier frame is rolled back past the vertical using the loader boom assembly.

2. The invention in accordance with claim 1 wherein said carrier comprises:

an outboard wall having a first top and a first bottom mounting pin receiving aperture; and in said outboard wall an aperture for receiving said locking pin; and a vertical crease in said outboard wall that divides a forward section from a rear section of said outboard wall while providing that said forward section be offset inwardly in relation to said rear section;

an inboard wall having a first top and a first bottom mounting pin receiving aperture; and a vertical crease in said inboard wall that divides a forward section from a rear section while providing that said forward section be offset inwardly in relation to said rear section;

an upwardly opening saddle connecting the forward upper section of said outboard wall to the forward upper section of said inboard wall for receiving said second top mounting pin; and a forward opening alignment slot connecting the forward lower section of said outboard wall to the forward lower section of said inboard wall for receiving said second bottom work implement mounting pins;

a bracket mounted on the outboard wall having an offset forward portion for carrying said automatic locking mechanism.

3. In a loader boom assembly comprising extending adjustable arms each terminating at a forward portion having an aperture, implement operating links having apertured termination points, mounting pin means for attaching implements to said arms and said links through said apertures, and a detachable work implement having apertures for receiving locking pins and also having second top and bottom mounting pins installed therein, the improvement comprising an implement carrier frame for attaching and carrying said work implement on said loader boom assembly, said implement carrier frame having a left and a right carrier each carrier comprising:

a carrier having inboard and outboard sidewalls said sidewalls deformed vertically such that said outboard wall is deflected inward toward said inboard wall and said inboard wall is deflected toward said outboard wall while both walls remain parallel and equidistant from each other at their respective forward and rear sections as defined by said vertical deformation; and said carrier having first top and bottom apertures on said rear section of said inboard and outboard walls for mounting said boom assembly using said first top and bottom mounting pins; and formed in the forward upper section of said carrier, a connected upper recess defining a saddle for receiving said second top mounting pin of said work implement; and formed in the lower forward section of said carrier, a connected lower recess defining a slot for aligning with said second bottom mounting pin of said work implement;

an automatic locking mechanism fixedly attached to said rear section of said outboard wall of said carrier with the front portion of said automatic locking mechanism offset outwardly from the forward section of said outboard wall of said carrier; and a kickoff means mounted on said loader boom assembly for initiating locking action through interaction with said automatic locking mechanism when said carrier is rolled back past the vertical using the implement operating links.

4. In a loader boom assembly comprising extending adjustable arms each terminating at a forward portion having an aperture, implement operating links having apertured termination points, first mounting pin means for attaching implements to said arms and said links through said apertures, and a detachable work implement having apertures for receiving locking pins and also having second top and bottom mounting pins installed therein, the improvement comprising an implement carrier frame for attaching and carrying said work implement on said loader boom assembly, said implement carrier frame comprising:

a pair of carriers having inboard and outboard sidewalls said sidewalls deformed vertically such that said outboard walls are deflected inward toward said inboard walls and said inboard walls are deflected toward said outboard walls while both walls remain parallel and equidistant from each other at their respective forward and rear sections as defined by said vertical deformation; and said carriers having first top and bottom apertures on said rear section of said inboard and outboard walls for mounting said boom assembly using said first top and bottom mounting pins; and formed in the forward upper section of each said carriers, connected upper recesses defining a saddle for receiving said second top mounting pins of said work implement; and formed in the lower forward section of each carrier, connected lower recesses defining slots for aligning with said second bottom mounting pins of said work implement;

a transverse stabilizer fixedly connecting said inboard plates of each of said pair of carriers;

an automatic locking mechanism fixedly attached to said rear section of said outboard walls of each of said carriers with the front portion of said automatic locking mechanism offset outwardly from the forward section of said outboard walls of said carriers; and a kickoff means mounted on said loader boom assembly for initiating locking action through interaction with said automatic locking mechanism.

5. In an automatic locking mechanism for use on an implement carrier frame carried on the forward portion of a pair of boom arms said automatic locking mechanism comprises:

a mounting bracket having a locking pin aperture in the forward portion thereof;

a cylindrical container attached to said mounting bracket in alignment with said locking pin aperture being opened at the inboard and outboard ends;

a locking pin rotatably carried inside said container capable of sliding through said locking pin aperture having a large diameter leading portion and a smaller diameter aft section;

a biasing means inside said container carried on said locking pin between said leading portion of said locking pin and said outboard end of said cylindrical container to urge said locking pin into said locking pin aperture and said work implement locking pin aperture;

a handle fixedly attached to said aft section of said locking pin to assist in retracting said pin against said biasing means, said handle comprising an extension to afford retention of the pin when retracted;

a lockout stop mounted on said cylindrical container positioned to receive said extension of said handle when said handle is rotated such that said lockout stop and said handle extension are in contact;

kickoff means attached to said boom arms having a projecting rod that upon contact with said handle will disengage said lockout stop and said handle extension and allow said biasing means to urge said locking pin through said cylinder until said handle limits the travel of said locking pin by coming to rest on said outboard portion of said cylinder.

6. The invention in accordance with claim 5 wherein said automatic locking mechanism can be maintained in an unlocked position through the engagement of said handle and said lockout stop.

7. A quick change attachment means to be attached to the boom assembly of a work vehicle for permitting connection of a variety of implements to the boom assembly comprising:

an implement carrier frame having carriers capable of supporting an implement;

an automatic locking mechanism carried by said implement carrier frame and movable between a locked position and an unlocked position;

biasing means for urging said automatic locking mechanism toward its locked position;

lockout stop means for retaining said automatic locking mechanism in said unlocked position; and kickoff means mounted on the boom assembly for disengaging said automatic locking mechanism from its retained position with said lockout stop means whereby said biasing means will urge said automatic locking means into a locked position in response to contact between said kickoff means and said automatic locking mechanism.

8. The invention as described in claim 7 wherein the implement carrier frame further comprises:

a pair of carriers having inboard and outboard sidewalls deformed vertically such that said outboard walls are deflected inward toward said inboard walls and said inboard walls are deflected toward said outboard walls while both walls remain parallel and equidistant from each other at their respective forward and rear sections on either side of said vertical deformation;

said carriers having first top and bottom apertures on said rear section of said inboard and outboard walls;

connected upper recesses formed in the forward upper section of each carrier;

connected lower recesses defining slots formed in the lower forward section of each carrier;

a transverse stabilizer connecting said inboard plate of each carrier together; and an automatic locking mechanism attached to the rear section of said outboard walls of at least one of said carriers with the front portion of said automatic locking mechanism offset outwardly from the forward section of said outboard wall of said carrier.

9. The invention in accordance with claim 7 wherein the automatic locking mechanism further comprises:

a mounting bracket having a locking pin aperture in the forward portion thereof;

a cylindrical container attached to said mounting bracket in alignment with said locking pin aperture being opened at the inboard and outboard ends;

a locking pin rotatably carried inside said container capable of sliding through said locking pin aperture having a large diameter leading portion and a smaller diameter aft section;

a biasing means inside said container carried on said locking pin between said leading portion of said locking pin and said outboard end of said cylindrical container to urge said locking pin into said locking pin aperture;

a handle fixedly attached to said aft section of said locking pin to assist in retracting said pin against said biasing means, said handle comprising an extension to afford retention of the pin when retracted;

a lockout stop mounted on said cylindrical container positioned to receive said extension of said handle when said handle is rotated such that said lockout stop and said handle extension are in contact;

kickoff means having a projecting rod that upon contact with said handle will disengage said lockout stop and said handle extension and allow said biasing means to urge said locking pin through said cylinder until said handle limits the travel of said locking pin by coming to rest on said outboard portion of said cylinder.

* * * * *